US012601348B2

(12) United States Patent
Gadhe et al.

(10) Patent No.: US 12,601,348 B2
(45) **Date of Patent: *Apr. 14, 2026**

(54) COMPRESSOR ASSEMBLIES INCLUDING LOWER COVERS HAVING MOUNTING FEET SKIRTS CONFIGURED FOR INCREASING MOUNTING FEET STIFFNESS AND RESISTANCE TO CRACK FORMATION

(71) Applicant: Copeland LP, Sidney, OH (US)

(72) Inventors: Rahul Sharad Gadhe, Pune (IN); Kamendra Singh, Pune (IN); Amod Vinay Khardekar, Pune (IN); Sanket Prabhakar Junghare, Pune (IN); Chad Allen Winner, Versailles, OH (US); Chase Austin Benning, Springfield, OH (US)

(73) Assignee: Copeland LP, Sidney, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/075,369

(22) Filed: Mar. 10, 2025

(65) Prior Publication Data

US 2025/0207584 A1 Jun. 26, 2025

Related U.S. Application Data

(63) Continuation of application No. 18/584,133, filed on Feb. 22, 2024, now Pat. No. 12,270,398.

(30) Foreign Application Priority Data

Dec. 26, 2023 (IN) ..... 202321088880

(51) Int. Cl.
*F04C 15/00* (2006.01)

(52) U.S. Cl.
CPC ..... *F04C 15/00* (2013.01); *F04C 2230/604* (2013.01); *F04C 2240/30* (2013.01); *F04C 2240/805* (2013.01)

(58) Field of Classification Search
CPC ..... F04C 15/00; F04C 29/00; F04C 2240/30; F04C 2240/805; F04C 2240/50;
(Continued)

(56) References Cited

U.S. PATENT DOCUMENTS 3,080,910 A 3/1963 Whitney, Jr.
3,138,358 A 6/1964 Comstock et al.
(Continued)

FOREIGN PATENT DOCUMENTS

JP 2023142291 A 10/2023
KR 101462934 B1 11/2014
WO WO-2013142709 A1 9/2013

OTHER PUBLICATIONS

PCT International Search Report and Written Opinion for PCT/US2024/061973 that is the parent application to the instant application; Apr. 21, 2025; 10 pages.

*Primary Examiner* — Dapinder Singh
(74) *Attorney, Agent, or Firm* — Harness, Dickey & Pierce, P.L.C.; Anthony G. Fussner

(57) ABSTRACT

Exemplary embodiments are disclosed of compressor assemblies including lower covers having mounting feet skirts configured for increasing mounting feet stiffness and provide better resistance to crack formation due to vibration, e.g., in mobile and transport applications, etc. The mounting feet skirts may comprise full, rounded, and/or radiused skirts disposed along or around the entire end portions of the mounting feet near the mounting holes (e.g., bolt holes, etc.) in the mounting feet. Using full, rounded, and/or radiused skirts avoids or eliminates sharp corners, such as the sharp
(Continued)

corner fillet features of conventional lower covers that are prone to having cracks form due to vibration while in transit.

29 Claims, 14 Drawing Sheets

(58) Field of Classification Search
CPC ..... F04C 2230/00; F04C 2230/60; F04C 2230/604; F01C 21/007
See application file for complete search history.

(56) References Cited

U.S. PATENT DOCUMENTS

| | | | | |
|---|---|---|---|---|
| 4,917,581 | A | 4/1990 | Richardson, Jr. et al. | |
| 5,399,944 | A | 3/1995 | Konopka et al. | |
| 5,524,860 | A | 6/1996 | Ives | |
| 6,247,909 | B1 | 6/2001 | Williams et al. | |
| 8,142,175 | B2 | 3/2012 | Duppert et al. | |
| 8,419,396 | B2 * | 4/2013 | Yasuzaka | F04C 27/003 418/268 |
| 10,344,804 | B2 * | 7/2019 | Knoth | F04C 29/00 |
| 11,376,783 | B2 | 7/2022 | Goad et al. | |
| 12,270,398 | B1 | 4/2025 | Gadhe et al. | |
| 2002/0182092 | A1 | 12/2002 | Milliff et al. | |
| 2002/0192094 | A1 | 12/2002 | Milliff et al. | |
| 2005/0053486 | A1 * | 3/2005 | Gilliam | F04C 23/008 417/363 |
| 2008/0219865 | A1 | 9/2008 | Hodapp et al. | |
| 2010/0025529 | A1 | 2/2010 | Perry et al. | |
| 2012/0128511 | A1 * | 5/2012 | Lee | F04C 18/3564 417/410.1 |
| 2012/0148805 | A1 | 6/2012 | Goad | |
| 2013/0037984 | A1 | 2/2013 | Arnauts | |

* cited by examiner

Current lower cover mount design challenges

Preload primary path from Washer to Grommet

Possible washer to cover interference

Sharp corner and sharp stiffness changes

Other possibilities making non-conformance of part

Summary with Relative Stress

| Sr No. | Design Option | Design Style | Mode1/Mode2 (Pitching) Hz | Mode3 (Bouncing) Hz | Stress Location A MPa | Stress Location B MPa |
|---|---|---|---|---|---|---|
| 1 | M076-005-A171-00 | No cutout tab and round skirt added | 74.6 | 229 | 460 | 418 |
| 2 | M076-005-A167-03/003 | Skirt cut out removed | 73.1 | 222.0 | 474 | 980 |
| 2 | M076-005-A167-00/003 | ZMD26 4.1mm thick non conformance design | 68.4 | 207 | 723 | 923 |

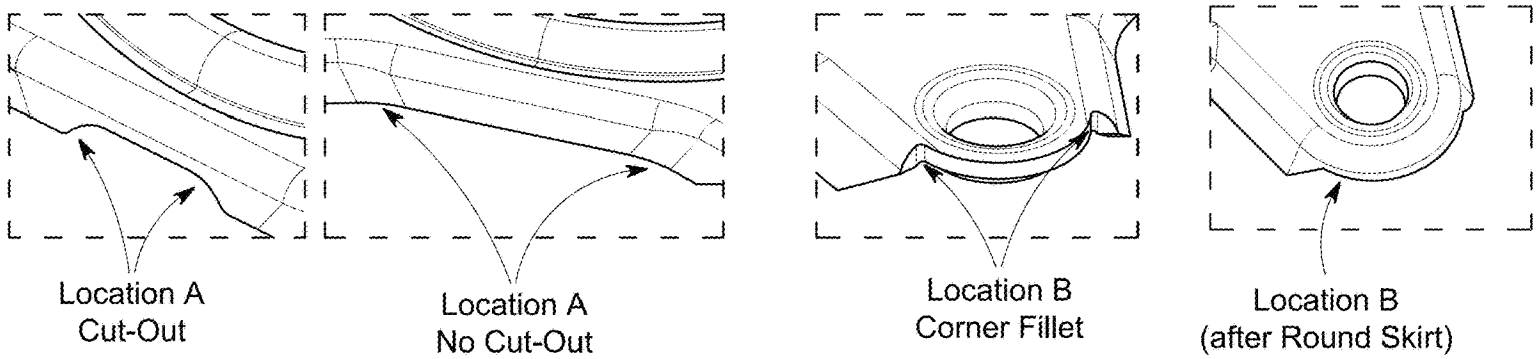

Major focus of this slide is to compare relative equivalent stress among design concepts for peak locations. As shown above, major peak during modal analysis occurs near cut-outs (location A) and near sharp feature (location B) near foot.

FIG. 8

Zoom in View (loc 1/2/3 life <96hrs)
Note : 0 = 96hr
Gray colour shows life is < 96 hr (Not meeting requirement)
Life in hr = 10^(x)*96 where x - is legend

Alternative Solutions
Option - 1
Trimmed Skirt Design
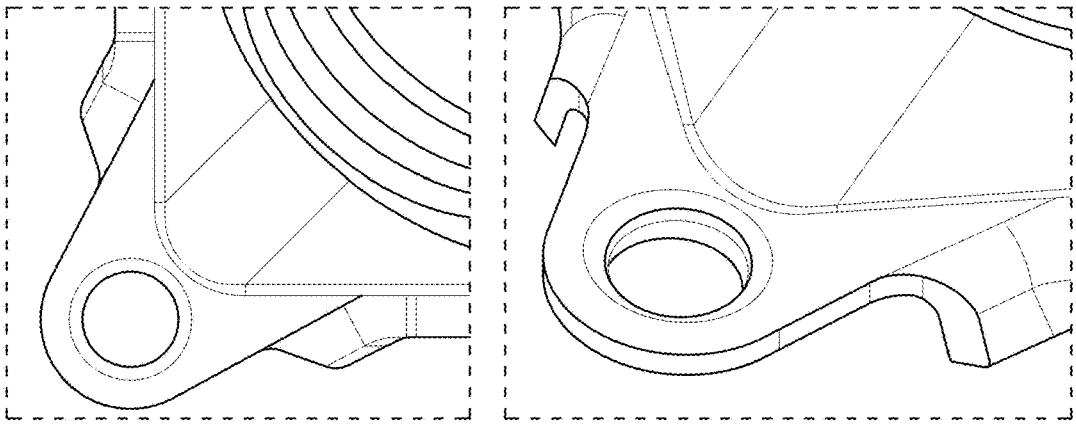
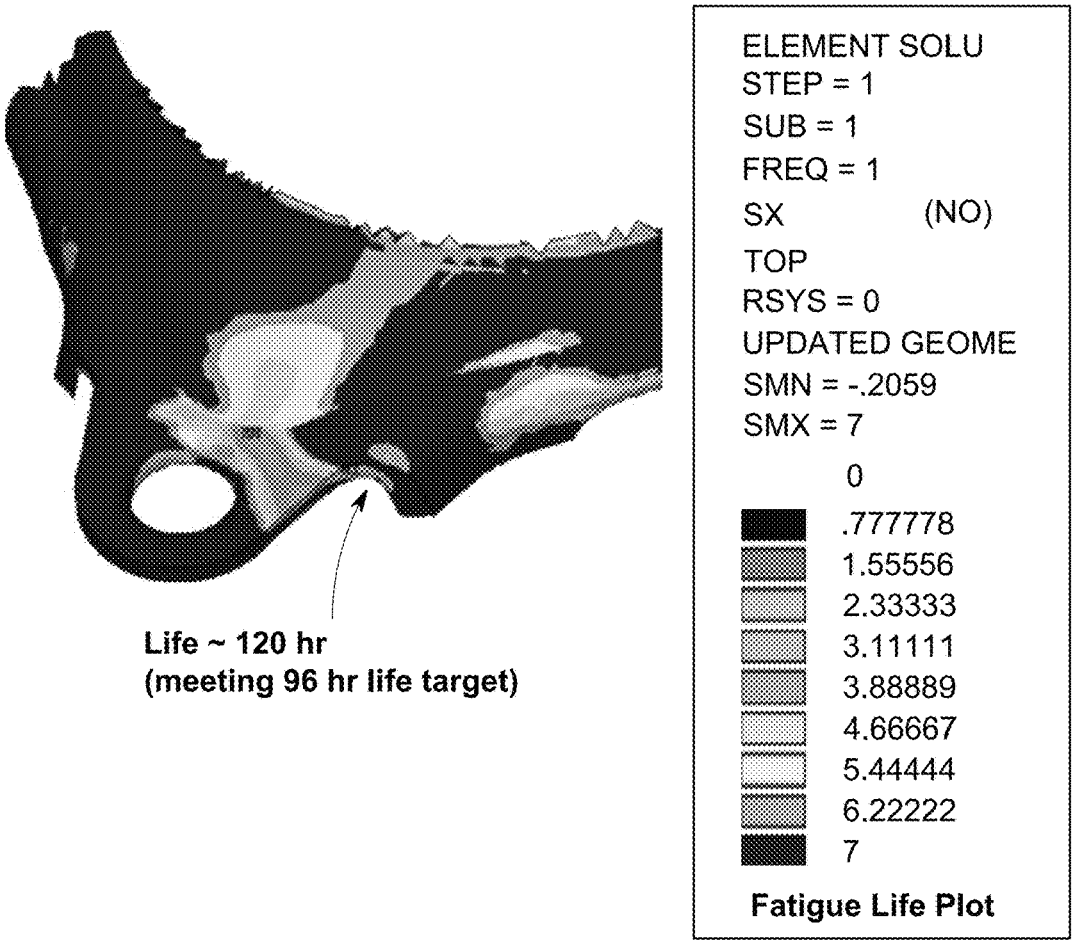
FIG. 9B

Alternative Solutions
Option - 2
Round Skirt Design
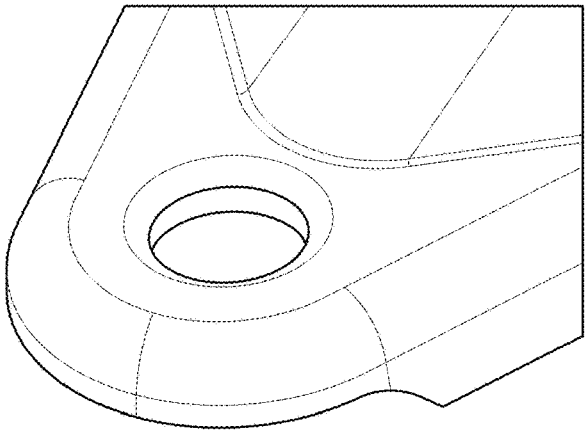
Round Skirt
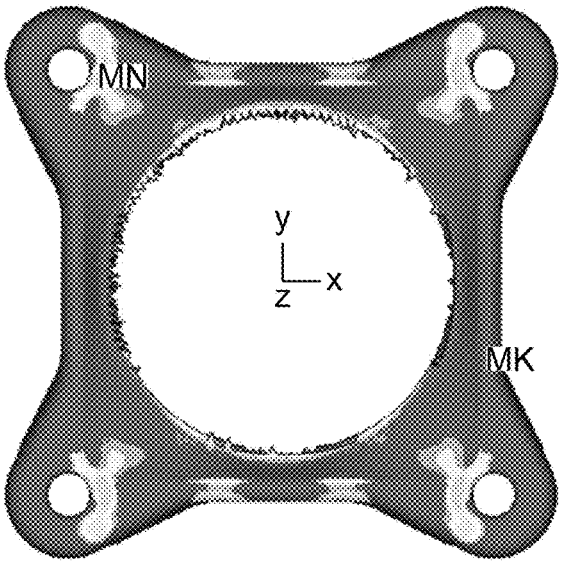
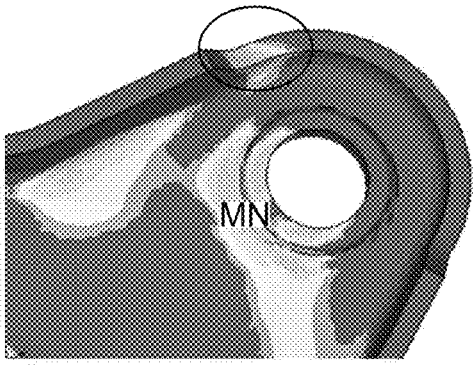
ELEMENT SOLUTION
STEP = 1
SUB = 1
FREQ = 1
SX (NOA
TOP
RSYS = 0
UPDATED GEOMET
SMN = -.314
SMX = 7
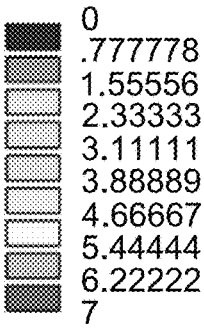
Fatigue Life plot
Life > 85,000 hrs
FIG. 9C

| Sr No | Design | Frequency | | min Life, hrs |
|---|---|---|---|---|
| | | Mode1/2 | Mode 3 | |
| 1 | non- confirmation design | 56.5 | 170 | 33.5 |
| 2 | Circular Lower Cover | 66.6 | 202 | 555 |
| 3 | Square Lower Cover | 58.5 | 176 | 361 |

The Proposed Circular or Square Lower Cover design increases the Natural Frequency and thus keeps part away from resonance thus reducing dynamic stresses responsible for failure.

COMPRESSOR ASSEMBLIES INCLUDING LOWER COVERS HAVING MOUNTING FEET SKIRTS CONFIGURED FOR INCREASING MOUNTING FEET STIFFNESS AND RESISTANCE TO CRACK FORMATION

CROSS-REFERENCE TO RELATED APPLICATIONS

This application is a continuation of allowed U.S. patent application Ser. No. 18/584,133 filed Feb. 22, 2024, which claimed priority to and the benefit of Indian Patent Application number 202321088880 filed Dec. 26, 2023. These applications are incorporated herein by reference in their entirety.

FIELD

The present disclosure relates to compressor assemblies including lower covers having mounting feet skirts configured (e.g., full, rounded, and/or radiused skirts, etc.) for increasing mounting feet stiffness and provide better resistance to crack formation due to vibration, e.g., in mobile and transport applications, etc.

BACKGROUND

This section provides background information related to the present disclosure which is not necessarily prior art.

The general structure of a scroll compressor includes the shell compressor internal components and mounting portions. Generally, the mounting portions includes a lower cover, which may be coupled to the shell of the scroll compressor. The lower cover includes mounting feet including mounting holes or apertures with or without slots. The holes or apertures in the mounting feet are configured for receiving mechanical hardware (e.g., bolts, etc.) for mounting the scroll compressor to a base. The lower cover may act as a base of the scroll compressor for positioning the scroll compressor at a required location with the help of a mounting system, e.g., grommets, bolts, rails, etc.

For example, FIG. 1 illustrates a scroll compressor 1 for a transport application. FIGS. 2 and 3 illustrate the conventional lower cover 5 of the scroll compressor 1. The lower cover 5 includes open-ended mounting feet 9 having mounting holes or apertures 13 with slots 17. As shown in FIG. 1, bolts and other mechanical hardware 21 may be used for mounting the scroll compressor 1 to a base 25 via the holes or apertures 13 in the mounting feet 9. FIG. 4 illustrates another conventional lower cover 105 including close-ended mounting feet 109 having mounting holes or apertures 113 without slots.

DRAWINGS

The drawings described herein are for illustrative purposes only of selected embodiments and not all possible implementations and are not intended to limit the scope of the present disclosure.

Figure 5A:
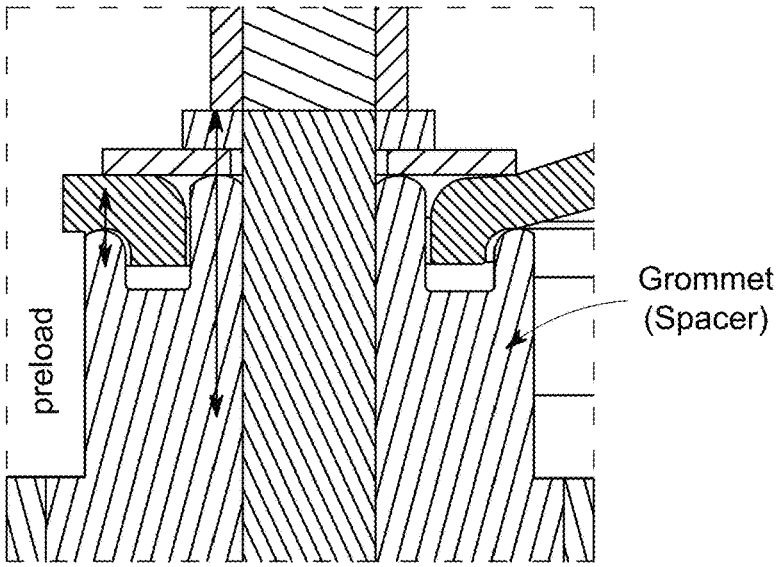
Figure 5B:
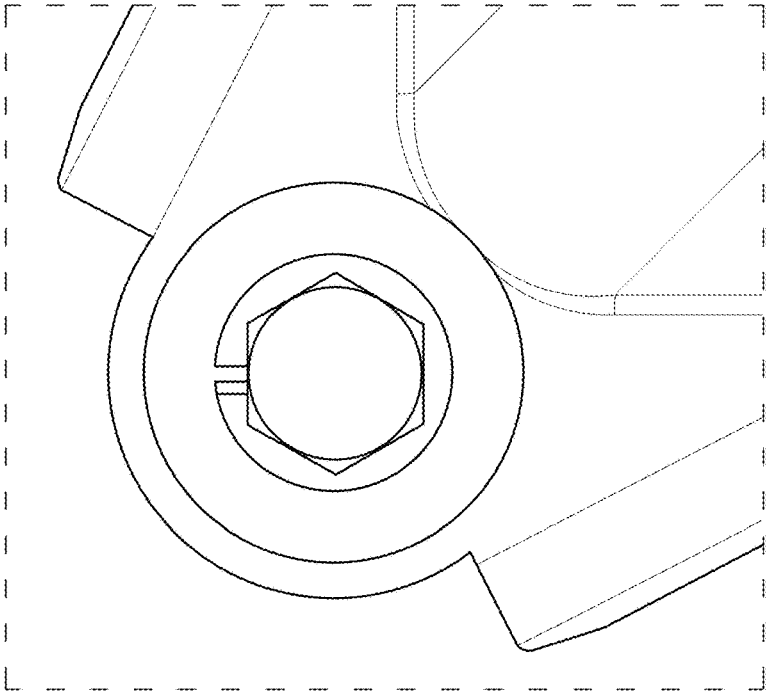
Figure 5C:
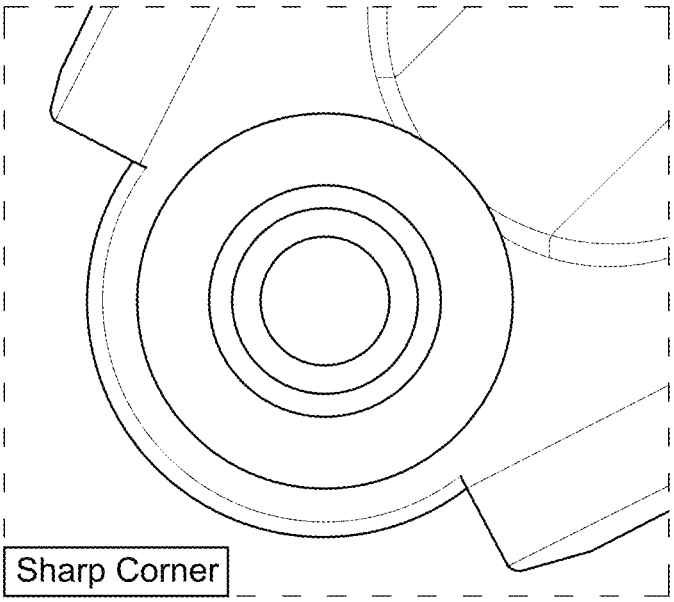
Figure 5D:
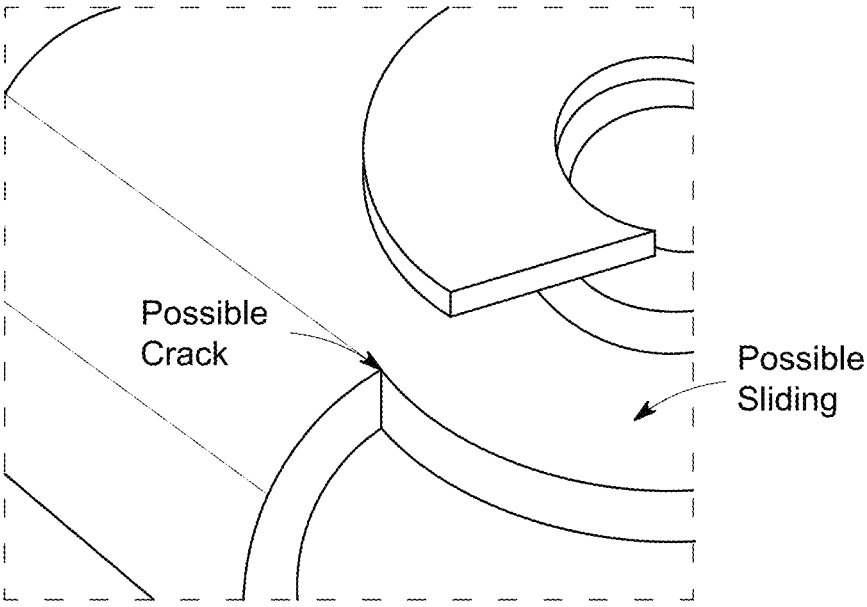

FIGS. 5A, 5B, 5C, and 5D illustrate conventional lower cover mount design challenges including crack formation near a mounting foot having sharp corners near the mounting hole. FIG. 5A shows a preload primary path from the washer to a grommet (spacer). FIG. 5B shows a possible washer to cover interference. FIG. 5C shows sharp corner and sharp stiffness changes. FIG. 5D shows other possibilities (possible crack, possible sliding) making non-conformance of the part.

Figure 6:
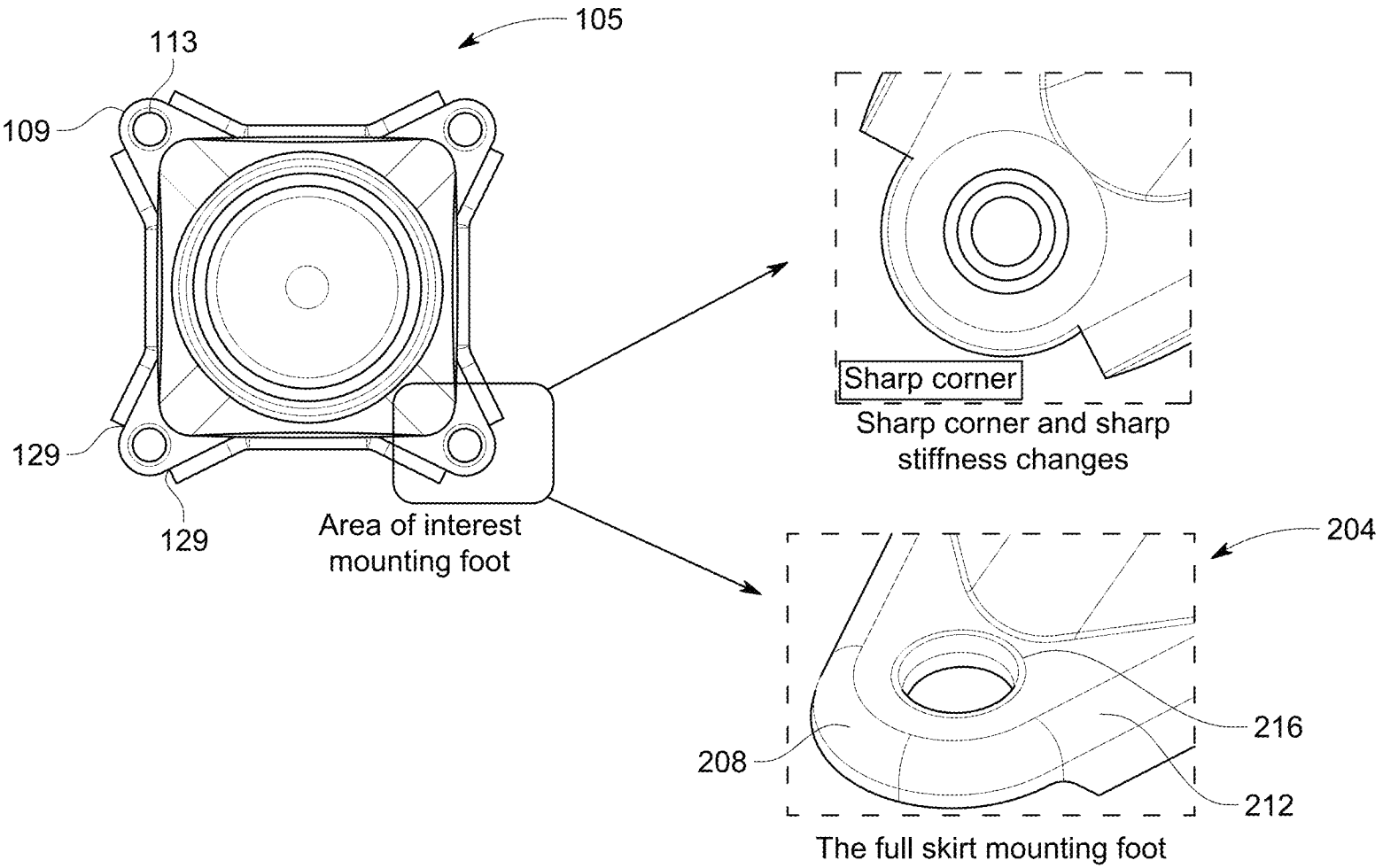

FIG. 6 illustrates a full skirt mounting foot (e.g., a full, rounded, and/or radiused skirt around the mounting foot near the mounting hole) of a lower cover according to an exemplary embodiment.

Figure 7:
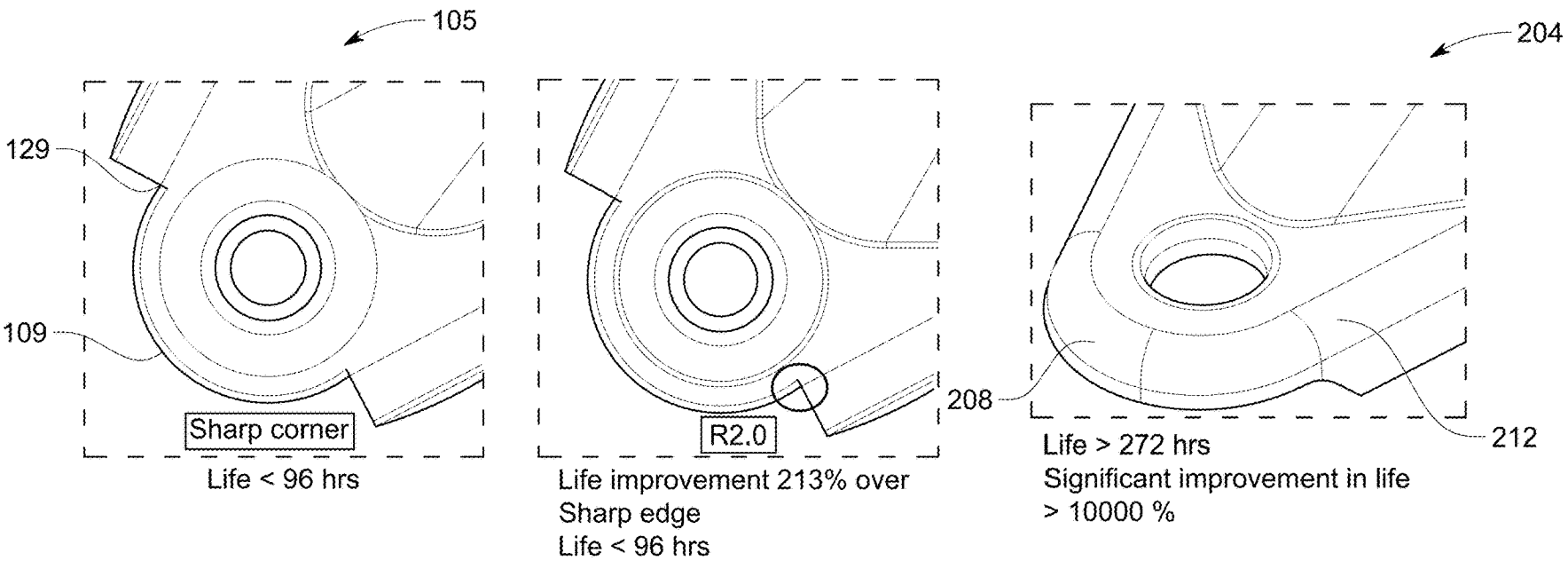

FIG. 7 illustrates that the random fatigue life calculated via a simulation shows that the full skirt mounting foot of the lower cover shown in FIG. 6 has a significantly improved overall life as compared to a conventional lower cover's mounting foot having sharp corner fillets.

FIG. 8 includes comparative simulation stress test results that illustrates benefits of using full, rounded, and/or radiused skirts around the mounting feet of a lower cover instead of the sharp corner fillets near the mounting feet of conventional lower covers.

Figure 9A:
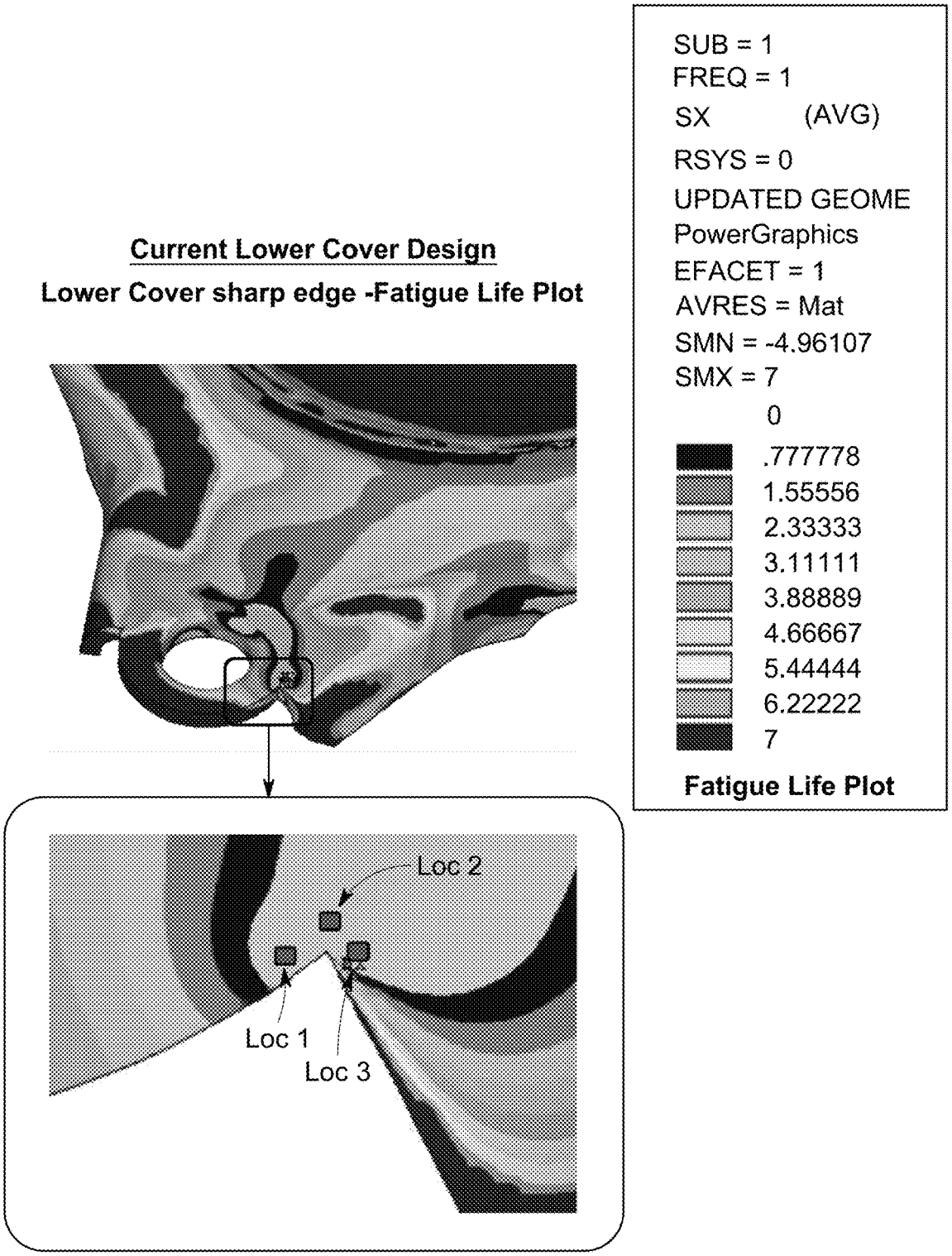

FIGS. 9A, 9B, and 9C include random fatigue life results/plots from a finite element analysis (FEA) for a conventional lower cover (FIG. 9A) having sharp corner fillet features along its mounting feet, a lower cover (FIG. 9B) having a trimmed skirt along its mounting feet, and a lower cover (FIG. 9C) having a full round skirt along its mounting feet.

Figure 10:
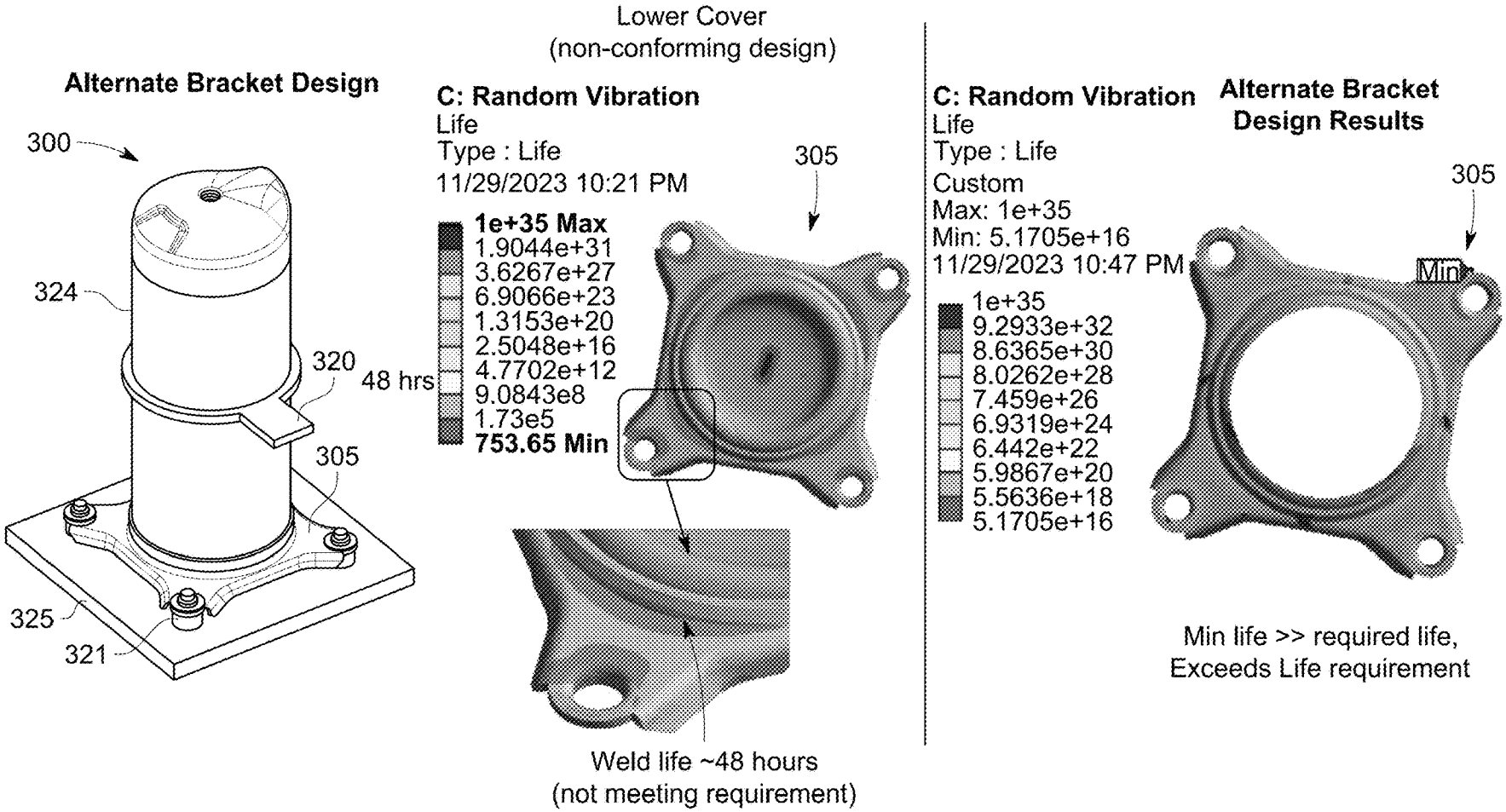

FIG. 10 illustrates a scroll compressor including a bracket around the compressor's shell, which bracket may be attached to a vertical support or nearby customer attachments according to an alternative exemplary embodiment.

Figure 11:
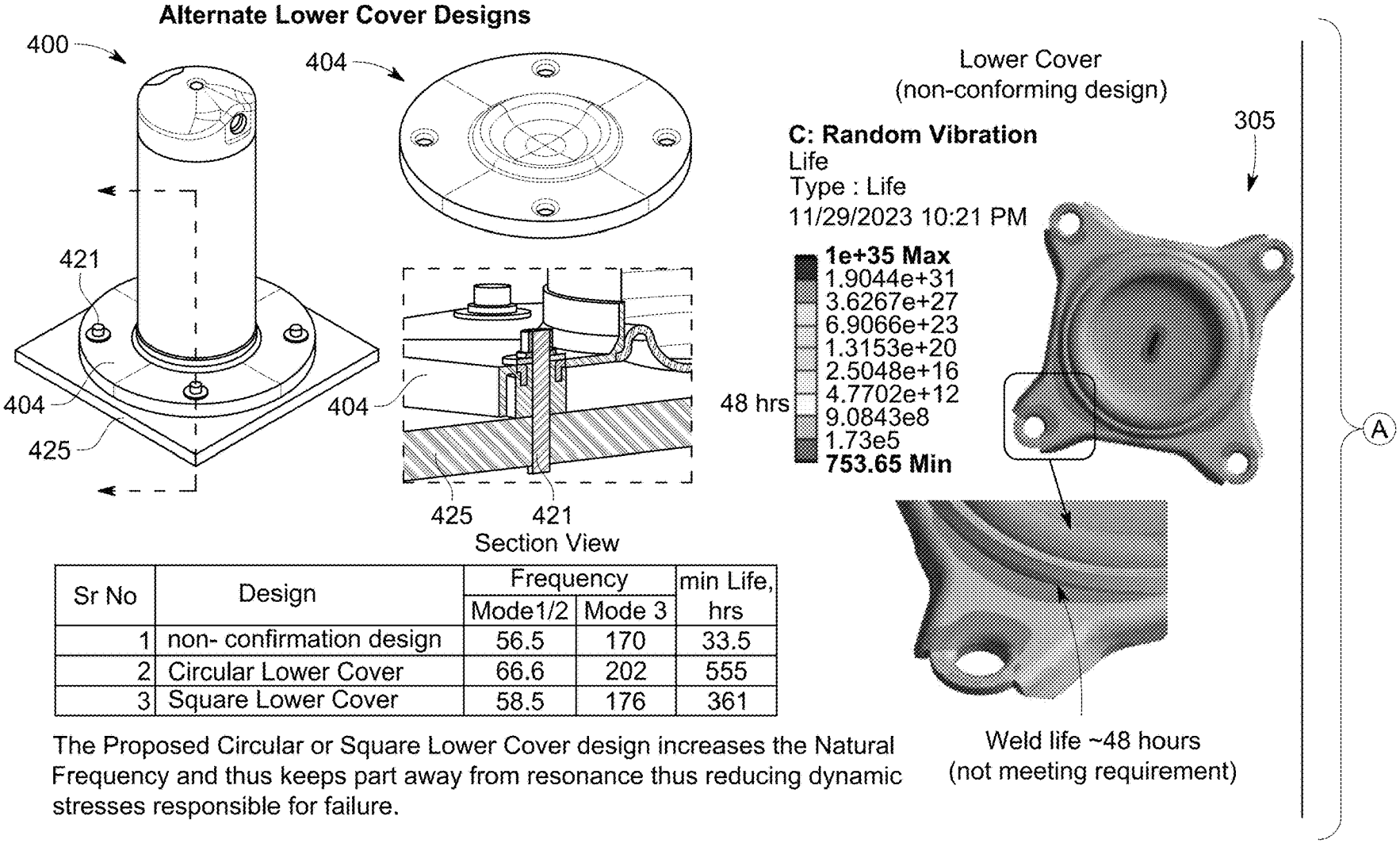
Figure 11:
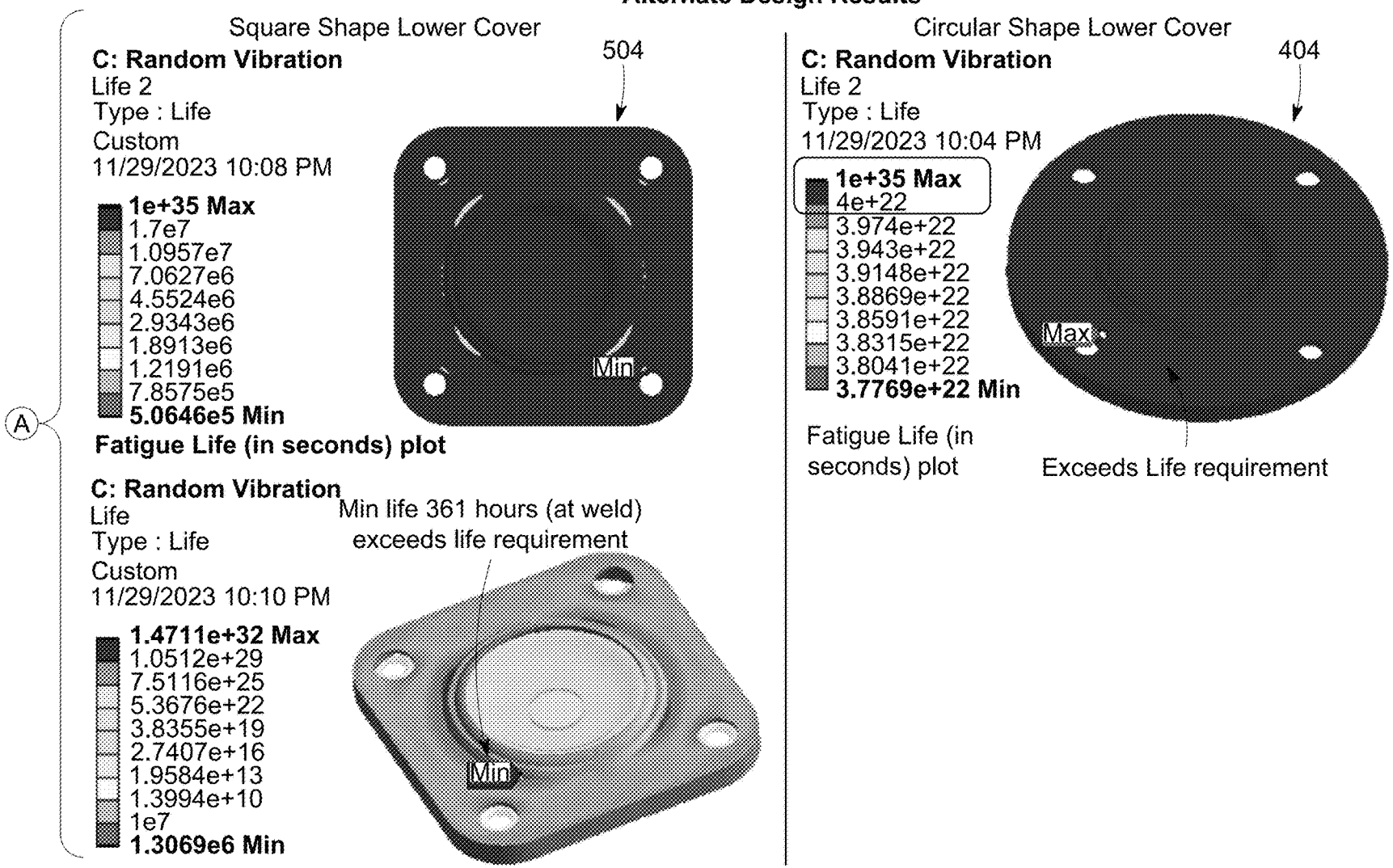

FIG. 11 illustrates a rectangular lower cover (e.g., square lower cover with rounded corners, etc.) and a circular lower cover that may be used for mounting a scroll compressor to a base according to alternative exemplary embodiments.

Corresponding reference numerals may indicate corresponding (though not necessarily identical) features throughout the several views of the drawings.

DETAILED DESCRIPTION

Example embodiments will now be described more fully with reference to the accompanying drawings.

Figure 4:
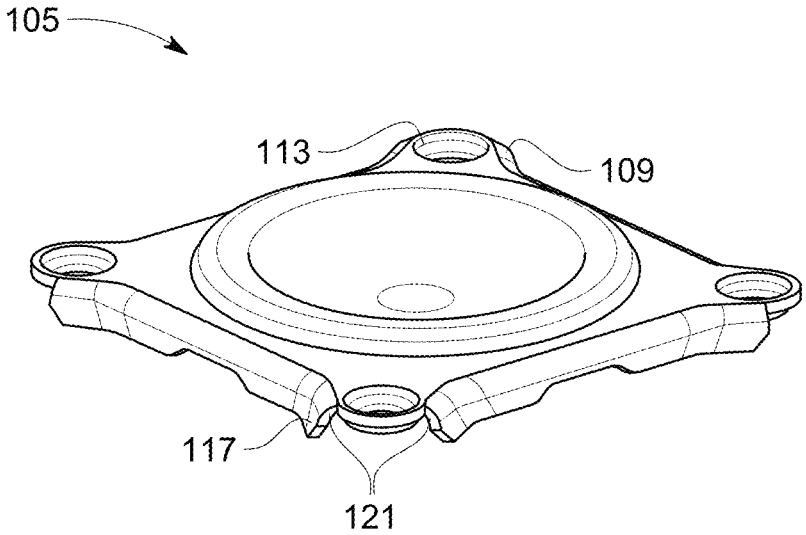
FIG. 4 (PRIOR ART)
FIG. 4 illustrates another conventional lower cover that may be used to mount a scroll compressor to a base.

FIG. 4 illustrates a conventional lower cover 105 including close-ended mounting feet 109 having mounting holes or apertures 113 without slots. The mounting holes 113 are configured for receiving bolts and other mechanical hardware for mounting a scroll compressor to a base. The conventional lower cover 105 does not include a skirt that extends entirely around the ends of the mounting feet 109 near the mounting holes 113. Instead, the conventional lower cover 105 includes an abbreviated skirt 117 that terminates and defines sharp corner fillet features 121 before the ends of the mounting feet 109.

FIGS. 5A, 5B, 5C, and 5D illustrate conventional lower cover mount design challenges including crack formation near a mounting foot having sharp corners near the mounting hole. FIG. 5A shows a preload primary path from the washer to a grommet (spacer). FIG. 5B shows a possible washer to cover interference. FIG. 5C shows sharp corner and sharp stiffness changes. FIG. 5D shows other possibilities (possible crack, possible sliding) making non-conformance of the part.

During qualification of some conventional scroll compressors using a modified MIL STD 810*g* profile, lower cover non-conformance/failure was observed near the mounting feet of the lower cover. As shown in FIG. 5D, cracks may form near the mounting feet of the lower cover during the transport specification of random vibration profile. The vicinity of the bolted joints contributing high mean stress followed by lower cover frequencies which are near to exciting frequencies are major drivers. The sharp features near the bolted joints are also contributing as stress risers. The operation excitation profile experienced by the lower cover is severe.

After recognizing the above, exemplary embodiments were developed and/or are disclosed herein of lower covers having mounting feet skirts configured (e.g., full, rounded, and/or radiused skirts, etc.) for increasing mounting feet stiffness and provide better resistance to crack formation due to vibration, e.g., in mobile and transport applications (e.g., road, marine, refrigerated trains, trailers, containers used in the mobile shipment of refrigerated goods, etc.), etc. The mounting feet skirts may comprise full, rounded, and/or radiused skirts disposed along or around the entire end portions of the mounting feet near the mounting holes (e.g., bolt holes, etc.) in the mounting feet. Using full, rounded, and/or radiused skirts avoids or eliminates sharp corners, such as the sharp corner fillet features of conventional lower covers that are prone to having cracks form due to vibration while in transit.

Figure 1:
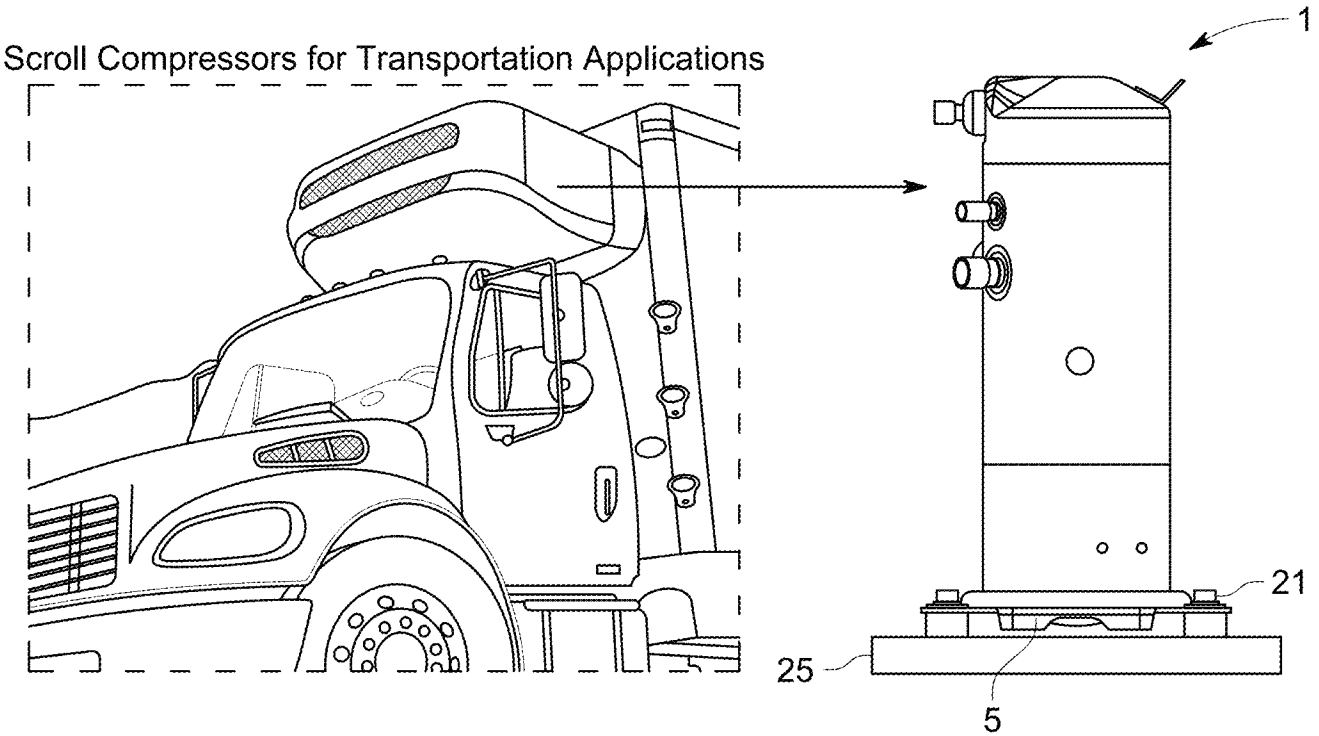
FIG. 1 (PRIOR ART)
FIG. 1 illustrates a conventional scroll compressor for a transport application, which scroll compressor includes a lower cover mounted to a base.
Figure 2:
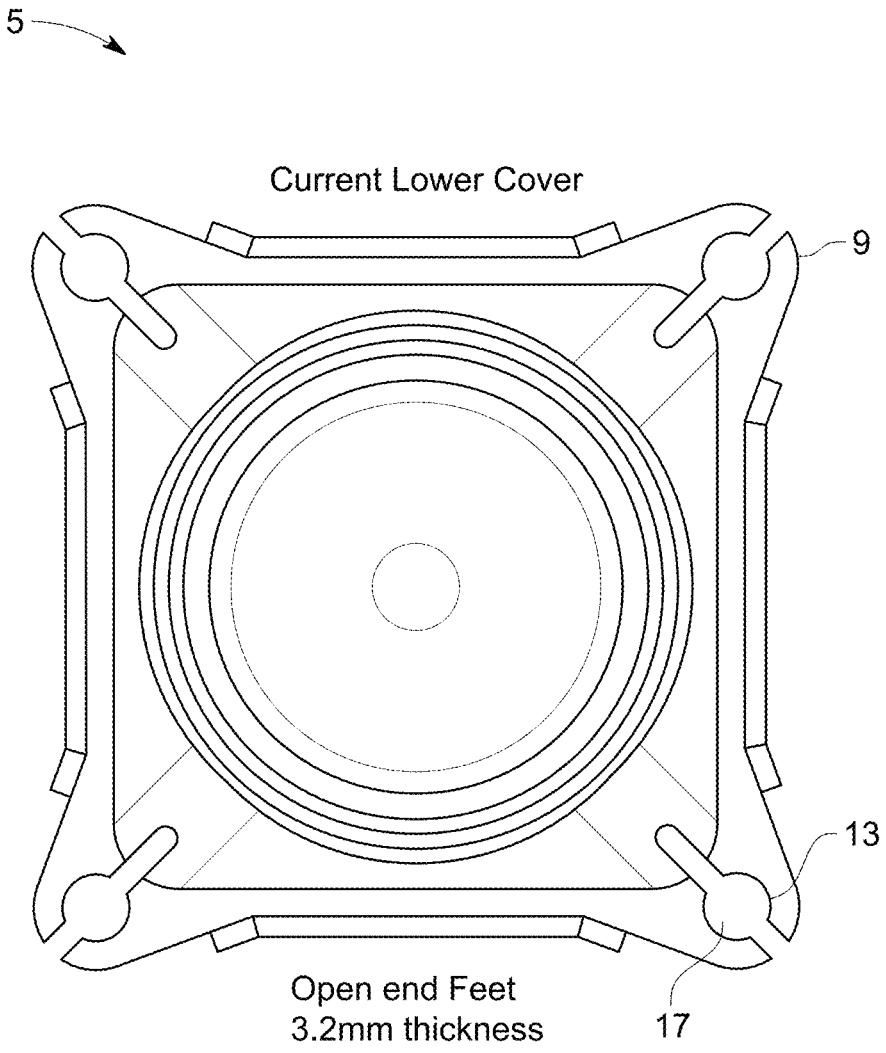
FIG. 2 (PRIOR ART)
FIGS. 2 and 3 illustrate the lower cover of the conventional scroll compressor shown in FIG. 1, wherein the lower cover has open end feet and a material thickness of 3.2 millimeters.
Figure 3:
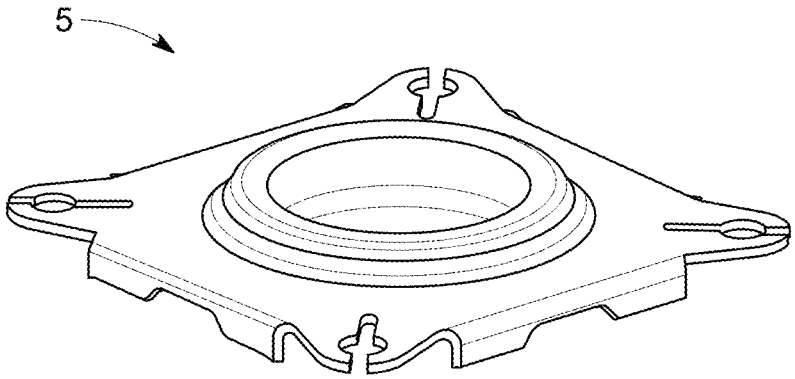
FIG. 3 (PRIOR ART)

In exemplary embodiments, full, rounded, and/or radiused skirts are configured to reduce the dynamic stress due to random vibration. The full, rounded, and/or radiused skirts replace, eliminate, or avoid the sharp features adjacent the mounting feet's holes or apertures in conventional lower covers (e.g., lower cover 5 (FIGS. 2 and 3), lower cover 105 (FIGS. 4, 6, 7), etc.), thus reducing the possibility of cracks around or near the mounting feet of the lower cover. Accordingly, exemplary embodiments disclosed herein may thus solve the problem of lower cover fracture due to transport random vibration.

FIG. 6 illustrates a full, rounded, and/or radiused skirt 208 around the mounting foot 212 having a mounting hole or aperture 216 of a lower cover 204 according to an exemplary embodiment. The full, rounded, and/or radiused skirt 208 replaces, eliminates, or avoids the sharp corners near the mounting feet of the conventional lower cover shown in FIG. 5C. The addition of the full, rounded, and/or radiused skit 208 improves the stress near the bolted joint and also increases natural frequencies, which drives frequencies away from loading frequencies.

FIG. 7 illustrates that the random fatigue life calculated via a simulation shows that the rounded and/or radiused fillet of the full skirt mounting foot 208, 212 of the lower cover 204 can significantly improve overall life as compared to the mounting foot 109 having sharp corner fillets 129 of the conventional lower cover 105. From left to right in FIG. 7, the first version 105 with the sharp corner had a life less than 96 hours. The second version with an R2.0 (instead of the sharp corner) provided a life improvement of 213% over the sharp edge first version. And the third version 204 with the full, rounded, and/or radiused skirt 208 had a life more than 272 hours and a life improvement more than 10000%. Accordingly, this significant increase in fatigue life demonstrates that the full, rounded, and/or radiused skirt 208 provides a good solution to address the severe vibration issue that may otherwise cause lower cover fracture.

FIG. 8 includes comparative simulation stress test results that illustrates benefits of using full, rounded, and/or radiused skirts around the mounting feet of a lower cover instead of the sharp corner fillets near the mounting feet of conventional lower covers. Generally, FIG. 8 includes a comparison of relative equivalent stress among different design concepts for peak locations. The major peak during modal analysis occurs near the cut-outs (Location A) and near sharp corner fillet features near the mounting foot (Location B).

In exemplary embodiments, the lower cover is manufactured by forming so as to have full, rounded, and/or radiused skirt mounting feet to thereby avoid the sharp edges present in conventional lower covers. The elimination or avoidance of sharp edges advantageously eliminates or minimizes crack formation that would otherwise occur due to the sharp edges in the conventional lower cover. Although a lower cover have full, rounded, and/or radiused skirt mounting feet may be made via a forming manufacturing process, other manufacturing processes may also be used. For example, a lower cover having full, rounded, and/or radiused skirt mounting feet may also be made by welding and/or joining sheet metal.

In exemplary embodiments, the lower cover includes round skirt mounting feet that provide good stiffness around the bolt joints, which increases the lower cover's first natural frequencies. The round skirt mounting feet features also eliminate stress risers that would otherwise occur at the sharp corners near the bolt joints in the conventional lower cover. The round skirt mounting feet significantly reduce the random stress and the possibility of crack formations.

FIGS. 9A, 9B, and 9C include random fatigue life results/plots from a finite element analysis (FEA) for a conventional lower cover (FIG. 9A) having sharp corner fillet features along its mounting feet, a lower cover (FIG. 9B) having a trimmed skirt along its mounting feet, and a lower cover (FIG. 9C) having a full round skirt along its mounting feet. Generally, FIGS. 9A, 9B, and 9C validate or show the significant improvement achievable when using full, rounded, and/or radiused skirt along the mounting feet of a lower cover.

FIG. 9A shows that the conventional lower cover having sharp corner fillet features along its mounting feet had a fatigue lift of only 96 hours. In FIG. 9A, the zoom in view shows that the locations 1, 2, 3 had a fatigue life less than 96 hours. The gray color shows life is less than 96 hours (not meeting 96 hour target requirement), zero equals ninety six hours, and life in hours equals 10^(x)*96 where x– is legend. FIG. 9B shows that the lower cover having a trimmed skirt design along its mounting feet had an improved fatigue life of about 120 hours, thus meeting the 96 hour life target. FIG. 9C shows that the lower cover having the full round skirt along its mounting feet had a significantly higher fatigue life of 85,000 hours. Accordingly, exemplary embodiments disclosed herein may help in increasing life of compressors for transport applications.

The full, rounded, and/or radiused skirt along a lower cover's mounting feet may be implemented with relatively little change being needed to existing parts and areas near interfaces. In exemplary embodiments, the lower cover skirting angle may be from 0 degree to 90 degrees with 90 degrees being the preferred lower cover skirting angle in some exemplary embodiments. The material for the lower cover and its full round skirt mounting feet may be selected or dependent upon requirement of fatigue life.

FIG. 10 illustrates a scroll compressor 300 including a bracket 320 around the compressor's shell 324 according to an alternative exemplary embodiment. The bracket 320 may be attached to a vertical support or nearby customer attachments. The bracket 320 is configured to eliminate resonance from pitch or pitching model of vibration of the scroll compressor, thus reducing dynamic stresses on the scroll compressor 300. Advantageously, the bracket 320 may be added without requiring any changes to the existing lower cover 305. The lower cover 305 is shown mounted to a base 325 with hardware 321 (e.g., bolts, washer, and grommets, etc.).

FIG. 10 also includes results from a finite element analysis (FEA) that validates the use of the bracket 320. The lower cover 305 had a weld life of about 48 hours, which is unsatisfactory or non-conforming to the requirement. When the bracket 320 is used, the lower cover 305 had a minimum life that exceeded the life requirement.

FIG. 11 illustrates a circular lower cover 404 that may be used for mounting a scroll compressor 400 to a base 425 with hardware 421 (e.g., bolts, washer, and grommets, etc.) according to an alternative exemplary embodiment. FIG. 11 also illustrates a rectangular lower cover 504 (e.g., square lower cover with rounded corners, etc.) that may be used for mounting the scroll compressor 400 to the base 425 with the hardware 421 according to an alternative exemplary embodiment.

The circular and rectangular lower covers 404 and 504 are configured to increase natural frequency and thus keep the part away from resonance thus reducing dynamic stresses responsible for fatigue life, as shown by the finite element analysis (FEA) results in FIG. 11. The lower cover 305 had a weld life of about 48 hours, which is unsatisfactory or non-conforming to the requirements. By comparison, the rectangular lower cover 504 had a minimum life of about 361 hours at the weld, which exceeded the life requirement. The circular lower cover 404 also exceeded the life requirement.

In exemplary embodiments, the lower cover may be generally rectangular (e.g., square, etc.) with the mounting feet extending outwardly from each of the four corners. The lower cover may also include additional features to help guide and support the shell of the compressor assembly. For example, the lower cover may include guide sections that align with the shell of the compressor assembly.

The lower covers including mounting feet skirts (e.g., full, rounded, and/or radiused skirts, etc.) disclosed herein may be used with a wide range of compressor assemblies, such as scroll compressors for transport applications (e.g., road, marine, refrigerated tracks, trailers, containers used in the mobile shipment of refrigerated goods, etc.), other compressors, etc. Accordingly, aspects of the present disclosure should not be limited to use with any one particular type of compressor.

Disclosed are exemplary embodiments of lower covers for mounting compressors to bases. In exemplary embodiments, the lower cover comprises mounting feet extending outwardly from the lower cover. The mounting feet include mounting holes therethrough for receiving hardware for attaching and securing a compressor to a base. A full skirt is along or defines an end portion of each mounting foot generally around the mounting hole in the mounting foot. The full skirt is configured for increasing mounting foot stiffness and provide better resistance to crack formation due to vibration.

In exemplary embodiments, each full skirt extends downwardly relative to an upper surface of the end portion of the corresponding mounting foot.

In exemplary embodiments, each full skirt extends downwardly at an angle of about 90 degrees relative to an upper surface of the end portion of the mounting foot.

In exemplary embodiments, each full skirt extends along the entire end portion of the mounting foot.

In exemplary embodiments, each full skirt comprises a radiused skirt along or defining the end portion of the mounting foot generally around the mounting hole in the mounting foot.

In exemplary embodiments, each full skirt comprises a rounded skirt along or defining the end portion of the mounting foot generally around the mounting hole in the mounting foot.

In exemplary embodiments, the full skirts are configured to eliminate sharp corner fillet features along the end portions of the mounting feet that may otherwise be prone to having cracks form therein due to vibration.

In exemplary embodiments, the lower cover includes a skirt extending downwardly along an outer perimeter of the lower cover between each adjacent pair of end portions of the mounting feet. The full skirts along the end portions of the mounting feet and the skirts extending downwardly along the perimeter of the lower cover between adjacent pairs of end portions of the mounting feet may be configured to define a continuous skirt along the outer perimeter of the lower cover. The continuous skirt along the outer perimeter of the lower cove may be configured to provide a smooth transition, without any sharp corner fillet features, between the full skirts along the end portions of the mounting feet and the skirts extending downwardly along the perimeter of the lower cover between adjacent pairs of end portions of the mounting feet.

In exemplary embodiments, the mounting feet are arranged at regular intervals along the lower cover.

In exemplary embodiments, the lower cover includes a generally rectangular portion having first, second, third, and fourth corners. And the mounting feet comprise first, second, third, and fourth mounting feet extending outwardly from the respective first, second, third, and fourth corners of the generally rectangular portion of the lower cover.

In exemplary embodiments, a distance that each full skirt extends downwardly relative to an upper surface of the end portion of the corresponding mounting foot is greater than a material thickness of the lower cover. For example, the distance that each full skirt extends downwardly relative to the upper surface of the end portion of the corresponding mounting foot may be at least two times greater than the material thickness of the lower cover.

In exemplary embodiments, a compressor assembly comprises a compressor and a lower cover as disclosed herein. The compressor assembly may comprise a shell, a compression mechanism within the shell, and a motor operable for driving the compression mechanism. The lower cover may be coupled with the shell such that the shell and the lower cover cooperatively define a chamber housing the compression mechanism and the motor therein. The mounting feet of the lower cover may extend outwardly at regular intervals along a circumference of the shell. The compressor assembly may comprise a scroll compressor.

In exemplary embodiments, a mounting system for supporting a compressor comprises a lower cover as disclosed herein. The mounting system may further include a base and mechanical fasteners configured to be received within the mounting holes of the mounting feet for attaching and securing the compressor to the base.

In exemplary embodiments, a method comprises mounting a compressor to a base using a lower cover as disclosed herein. The method may include attaching and securing the compressor to the base by using mechanical fasteners within the mounting holes of the mounting feet of the lower cover.

Example embodiments are provided so that this disclosure will be thorough and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "includes," "including," "has," "have," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected, or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer, or section. Terms such as "first," "second," and other numerical terms when used herein do not imply a sequence or order unless clearly indicated by the context. Thus, a first element, component, region, layer, or section discussed below could be termed a second element, component, region, layer, or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A lower cover for mounting a compressor to a base, the lower cover comprising:

mounting feet extending outwardly from the lower cover;

a full skirt along or defining an end portion of each mounting foot; and a skirt extending downwardly along an outer perimeter of the lower cover between each adjacent pair of end portions of the mounting feet;

wherein the full skirts along or defining the end portions of the mounting feet are shorter than the skirts extending downwardly along the perimeter of the lower cover between the adjacent pairs of end portions of the mounting feet.

2. The lower cover of claim 1, wherein each full skirt extends downwardly relative to an upper surface of the end portion of the corresponding mounting foot such that each full skirt is shorter than each skirt extending downwardly along the perimeter of the lower cover between the corresponding adjacent pair of end portions of the mounting feet.

3. The lower cover of claim 1, wherein each full skirt extends downwardly at an angle of about 90 degrees relative to an upper surface of the end portion of the mounting foot.

4. The lower cover of claim 1, wherein each full skirt extends along the entire end portion of the mounting foot.

5. The lower cover of claim 1, wherein each full skirt comprises a radiused skirt along or defining the end portion of the mounting foot generally around a mounting hole in the mounting foot.

6. The lower cover of claim 1, wherein each full skirt comprises a rounded skirt along or defining the end portion of the mounting foot generally around the mounting hole in the mounting foot.

7. The lower cover of claim 1, wherein the full skirts are configured to eliminate sharp corner fillet features along the end portions of the mounting feet that may otherwise be prone to having cracks form therein due to vibration.

8. The lower cover of claim 1, wherein a distance that each full skirt extends downwardly relative to an upper surface of the end portion of the corresponding mounting foot is less than a distance that each skirt extends downwardly along the perimeter of the lower cover between the corresponding adjacent pair of end portions of the mounting feet.

9. The lower cover of claim 8, wherein the full skirts along or defining the end portions of the mounting feet and the skirts extending downwardly along the perimeter of the lower cover between adjacent pairs of end portions of the mounting feet are configured to define a continuous skirt that varies in height along the outer perimeter of the lower cover.

10. The lower cover of claim 9, wherein the continuous skirt along the outer perimeter of the lower cover is configured to provide a smooth transition, without any sharp corner fillet features, that accommodates for varying heights between the full skirts along or defining the end portions of the mounting feet and the skirts extending downwardly along the perimeter of the lower cover between adjacent pairs of end portions of the mounting feet.

11. The lower cover of claim 1, wherein the mounting feet are arranged at regular intervals along the lower cover.

12. The lower cover of claim 1, wherein:

the lower cover includes a generally rectangular portion having first, second, third, and fourth corners; and the mounting feet comprise first, second, third, and fourth mounting feet extending outwardly from the respective first, second, third, and fourth corners of the generally rectangular portion of the lower cover.

13. The lower cover of claim 1, wherein a distance that each full skirt extends downwardly relative to an upper surface of the end portion of the corresponding mounting foot is greater than a material thickness of the lower cover.

14. The lower cover of claim 13, wherein the distance that each full skirt extends downwardly relative to the upper surface of the end portion of the corresponding mounting foot is at least two times greater than the material thickness of the lower cover.

15. The lower cover of claim 1, wherein the mounting feet include mounting holes therethrough for receiving hardware for attaching and securing the compressor to the base.

16. The lower cover of claim 1, wherein each full skirt is generally around a mounting hole in the corresponding mounting foot.

17. The lower cover of claim 1, wherein each full skirt is configured for increasing both mounting foot stiffness and resistance to crack formation due to vibration.

18. A compressor assembly comprising a compressor and the lower cover of claim 1.

19. A mounting system for supporting a compressor, the mounting system comprising the lower cover of claim 1, a base, and mechanical fasteners configured to be received within mounting holes of the mounting feet for attaching and securing the compressor to the base.

20. A compressor assembly comprising:

a shell;

a compression mechanism within the shell;

a motor operable for driving the compression mechanism; and a lower cover including:

mounting feet extending outwardly from the lower cover;

a full skirt along or defining an end portion of each mounting foot; and a skirt extending downwardly along an outer perimeter of the lower cover between each adjacent pair of end portions of the mounting feet;

wherein the full skirts along or defining the end portions of the mounting feet are shorter than the skirts extending downwardly along the perimeter of the lower cover between the adjacent pairs of end portions of the mounting feet.

21. The compressor assembly of claim 20, wherein the compressor assembly comprises a scroll compressor.

22. The compressor assembly of claim 20, wherein a distance that each full skirt extends downwardly relative to an upper surface of the end portion of the corresponding mounting foot is less than a distance that each skirt extends downwardly along the perimeter of the lower cover between the corresponding adjacent pair of end portions of the mounting feet.

23. The compressor assembly of claim 20, wherein the full skirts along or defining the end portions of the mounting feet and the skirts extending downwardly along the perimeter of the lower cover between adjacent pairs of end portions of the mounting feet are configured to define a continuous skirt that varies in height along the outer perimeter of the lower cover.

24. The compressor assembly of claim 23, wherein the continuous skirt along the outer perimeter of the lower cover is configured to provide a smooth transition, without any sharp corner fillet features, that accommodates for the varying heights between the full skirts along or defining the end portions of the mounting feet and the skirts extending downwardly along the perimeter of the lower cover between adjacent pairs of end portions of the mounting feet.

25. The compressor assembly of claim 20, wherein each full skirt is generally around a mounting hole in the corresponding mounting foot.

26. The compressor assembly of claim 20, wherein each full skirt is configured for increasing both mounting foot stiffness and resistance to crack formation due to vibration.

27. The compressor assembly of claim 20, wherein the lower cover is coupled with the shell such that the shell and the lower cover cooperatively define a chamber housing the compression mechanism and the motor therein.

28. The compressor assembly of claim 20, wherein the mounting feet of the lower cover extend outwardly at regular intervals along a circumference of the shell.

29. A mounting system for supporting a compressor, the mounting system comprising:

a base;

mechanical fasteners; and a lower cover including:

mounting feet extending outwardly from the lower cover and including mounting holes therethrough; and a full skirt along or defining an end portion of each mounting foot; and wherein the mechanical fasteners are configured to be received within the mounting holes of the mounting feet for attaching and securing the compressor to the base;

wherein the lower cover includes a skirt extending downwardly along an outer perimeter of the lower cover between each adjacent pair of end portions of the mounting feet; and wherein a distance that each full skirt extends downwardly relative to an upper surface of the end portion of the corresponding mounting foot is less than a distance that each skirt extends downwardly along the perimeter of the lower cover between the corresponding adjacent pair of end portions of the mounting feet.

* * * * *